United States Patent [19]

Marquez

[11] 4,220,189

[45] Sep. 2, 1980

[54] WINDOW SHADE SEALING SYSTEM

[76] Inventor: Fidencio G. Marquez

[21] Appl. No.: 970,472

[22] Filed: Dec. 18, 1978

[51] Int. Cl.[2] ..... E04F 10/06; E04B 9/08

[52] U.S. Cl. ..... 160/23 R; 160/269

[58] Field of Search ..... 160/267, 269, 354, 349 R, 160/23 R, 290

[56] References Cited

U.S. PATENT DOCUMENTS

| | | | |
|---|---|---|---|
| 1,904,968 | 4/1933 | Bredin | 160/269 |
| 2,247,306 | 6/1941 | Partridge | 160/267 |
| 2,311,348 | 2/1943 | Peters et al. | 160/267 |
| 2,548,041 | 4/1951 | Morse | 160/269 |
| 3,855,642 | 12/1974 | Blitch | 160/349 R |
| 4,133,367 | 1/1979 | Abell | 160/354 |

*Primary Examiner*—Peter M. Caun

[57] ABSTRACT

A complete window shade and sealing system is provided as a separate unit having peel-off adhesive permitting all portions of the system to be press-fitted onto an existing window frame, creating a completely sealed cover for the window when the shade is in its down position, preventing the entry of air, dust, radio-active fall-out, etc., and greatly reducing energy-sapping heat transfers occurring through the window by creating an air pocket.

2 Claims, 6 Drawing Figures

WINDOW SHADE SEALING SYSTEM

BACKGROUND OF THE INVENTION

With the advent of the world wide shortage of energy and the dissipation of energy sources architectural trends have tended toward buildings with fewer windows, as the provision of additional windows is ordinarily linked with the belief that additional loss of heated and air conditioned air from within will occur. This problem can be dimished somewhat by the utilization of thermal window glass, or providing a double pane, but this may be difficult to do on existing buildings and is expensive in new buildings.

Whereas it has been known that curtains are of some benefit in acting as a heat barrier in front of a window, and whereas window shades have been invented having improved means of sealing, or at least holding the periphery against the window frame, no easily mounted window shade and sealing system has been developed coupling the advantages of a sealed panel with the convenience and universal adaptability of curtains.

SUMMARY OF THE INVENTION

The present invention fulfills the above mentioned gap by providing a window shade system having a conventional roller-mounted shade which is retained in a shade housing having a narrow slit one side of which is a mounting strip having peel-off adhesive material thereon to mount the roller housing to the window frame, the other side of this slit being a resilient pressure-bearing lip pressing the shade against the mounting strip as it is withdrawn or retracted from the roll.

Two vertical channels as well as a bottom channel are provided to capture the edges of the shade in such a way that they are sealed against the window frame, thus positively preventing the passage of air from the window around the shade into the room. The channels along the sides and the bottom of the shade which capture the edges thereof are also covered on their mounting sides with peel-off adhesive material so that the entire system need merely be peeled and pressed into place along a window frame, permitting an entire window to be fitted with this sealing mechanism in seconds.

DETAILED DESCRIPTION OF THE PREFERRED EMBODIMENT

Figure 2:
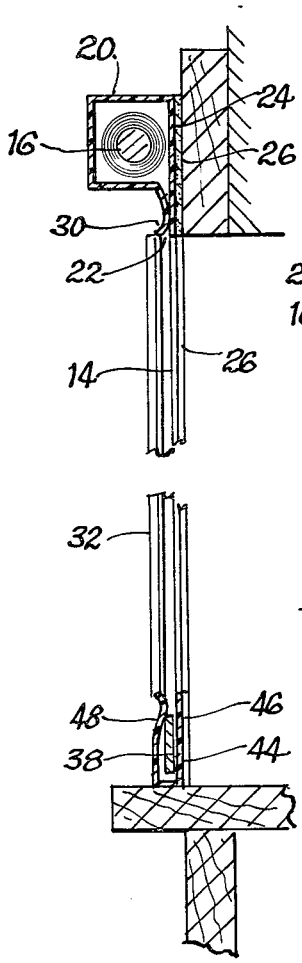
FIG. 2 is a sectional view taken along line 2–2 of FIG. 1 but with the shade all the way down.
Figure 2A:
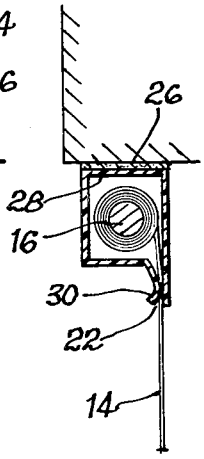
FIG. 2*a* is a detail of the shade roller housing in an alternative mounting mode.

A window is shown in FIG. 10 wherein the window proper indicated at 10 is enclosed in a surrounding frame 12, usually of wooden construction. A window shade 14 is wound on a roller 16 which is spring-mounted in conventional fashion. The roll is pivoted at 18 inside the roller housing 20 which preferably defines a complete enclosure around the roller to act as a secondary barrier in the event of some trace air seepage through the slit 22. This slit is defined on one side by the mounting strip 24 which mounts directly to a vertical surface as shown in FIG. 2 by virtue of the peel-back adhesive strip 26, or mounts as shown in 2*a* wherein the mounting strip connects to a back panel 28 adhered to the window frame. The other side of the slit 22 is formed by a resilient pressure applying lip 30 such that the pay-out slit 22 rather firmly pinches the shade as it is pulled out or retracted, preventing the passage of air therethrough.

Figure 3:
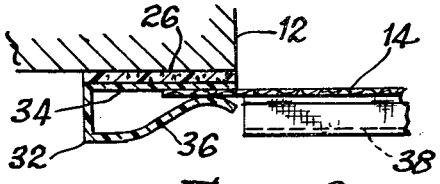
FIG. 3 is a section taken along line 3–3 of FIG. 1.
Figure 4:
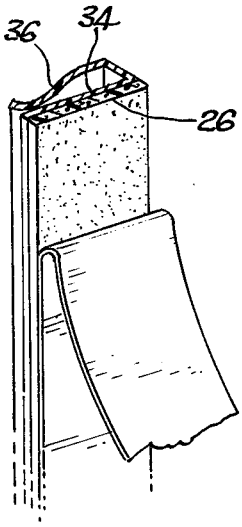
FIG. 4 is a perspective view of a portion of the side channel having the adhesive protective layer partially peeled away.

Vertical side channels 32 are shown in detail in FIGS. 3 and 4 and have a front sealing strip 34 with the peel-back adhesive 26 mounted thereto. These channels are U-shaped by virtue of an extended resilient lip 36 which is a pressure bearing member against the edge of the shade to hold it against the sealing strips 34 after the channels have been mounted with the adhesive strips 26 properly parallel thus defining tracks guiding the edges of the window shade.

Figure 1:
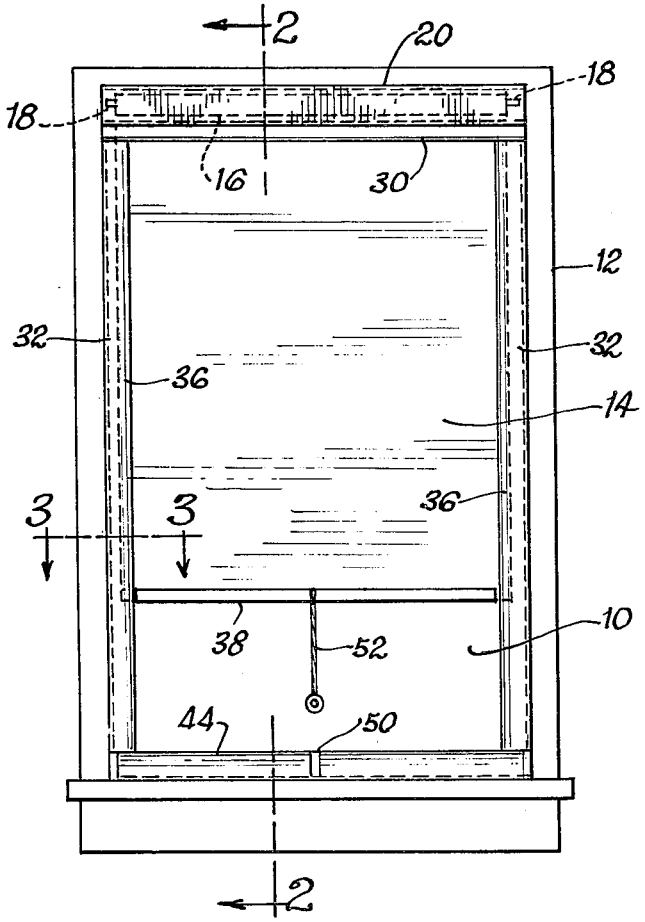
FIG. 1 is a front elevation view somewhat diagrammatically presented of a window having the system in place.

The bottom of the shade includes a slat 38 to provide it with rigidity, and as can be seen in FIGS. 1 and 3 this slat may terminate at the entry into the side channels so that the resilience of the lips 36 need not be sufficient to expand and close after the passage therethrough of the slat.

Figure 3A:
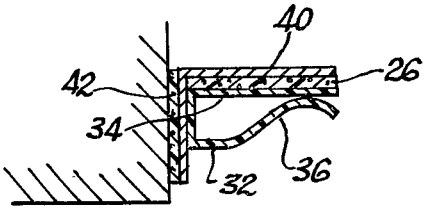
FIG. 3*a* is a sectional view of the channel showing an alternative mounting.

An alternative means of mounting the side channels is shown in FIG. 3*a*, wherein the peel-back adhesive strip 26 is utilized to mount the channel in an L-bracket 40 which is itself adhered by virtue of adhesive strip 42 to the window frame.

At the bottom of the parallel side channels 32 is a bottom channel 44 which could be identical to the side channels or modified slightly to ease the acceptance of the slat 38 therein. In either case, the bottom channel has a sealing strip 46 with peel-back adhesive and a frontal resilient lip 48 to accept the slat 38 and compress the shade against the sealing strip 46. A slot 50 may be cut in the lip 48 so that a pull cord or chain 52 may be pulled down through this slot to seat the slat 38 in an easy manner.

As described and claimed herein the shade sealing system is economical to manufacture, can be installed by virtually anyone regardless of experience, and thus will pay for itself, both production costs and installation effort, in a very short time by virtue of its advantages in preventing losses of heated and air conditioned air, especially in older buildings in which utilization of new construction techniques is not applicable.

I claim:

1. A window shade sealing system for sealing the entire periphery of a window shade covering a window having a continuous peripheral window frame to prevent the passage of air around said shade, said sealing system comprising:

(a) a shade roller housing mounting a roller shade and defining a pay-out slit through which the leading edge of a roller shade feeds, said slit defined at one side by an elongated mounting strip having means adhering same against said frame above said window and defined at the other side by a pressure-applying member compressing said shade against said mounting strip;

(b) a pair of resilient vertical guide channels and a horizontal bottom channel, each of said channels being generally U-shaped to straddle an edge of said shade and comprising a flat sealing strip having means adhering same to said window frame adjacent said window and a resilient pressure-applying lip compressed against said sealing strip with its outer edge in its normal state to press said shade at its vertical and bottom peripheral areas against said sealing strip, with the upper ends of said vertical guide channels aligned with said payout slit and the lower ends thereof aligned with said horizontal bottom channel, such that said shade is maintained in positively gripped sealed relation against said sealing strip continuously along its entire periphery whereby a complete instantly installed window shade and peripheral sealing apparatus is provided, any one unit of which is adaptable to fit window frames of different heights and irregular vertical side frame members.

2. A sealing system according to claim 1 wherein the bottom of said window shade includes an enlarged leading slat, and said pressure-applying lip is sufficiently resilient to open to admit said slat and close against said shade above said slat to retain said slat in said bottom channel.

* * * * *